United States Patent [19]

Smith et al.

[11] 4,172,597

[45] Oct. 30, 1979

[54] MAGNETIC PICK-UP DEVICE AND MARKER

[75] Inventors: David A. Smith, Dublin; John M. Grace, San Francisco, both of Calif.

[73] Assignee: Regale Enterprises, Pleasanton, Calif.

[21] Appl. No.: 904,750

[22] Filed: May 11, 1978

[51] Int. Cl.[2] ..... A63F 3/06

[52] U.S. Cl. ..... 273/239; 273/269; 273/148 R; 294/65.5

[58] Field of Search ..... 273/148 R, 239, 288, 273/1 M, 269; 294/65.5

[56] References Cited

U.S. PATENT DOCUMENTS

| | | | |
|---|---|---|---|
| 3,684,288 | 8/1972 | Grace | 273/239 |
| 3,782,726 | 1/1974 | Huffman et al. | 46/240 |
| 3,823,942 | 7/1974 | Duncan | 273/96 B X |
| 4,019,747 | 4/1977 | Chuilli | 273/239 |

FOREIGN PATENT DOCUMENTS

| | | | |
|---|---|---|---|
| 716761 | 8/1965 | Canada | 35/66 |
| 564925 | 8/1975 | Switzerland | 273/148 R |

*Primary Examiner*—Anton O. Oechsle

[57] ABSTRACT

An improved magnetic pick-up device and marker for use in games includes a rectangular ferromagnetic member having a length substantially greater than width. The ferromagnetic member is fixedly received in a rectangular socket affixed to an elongated handle. The handle with the ferromagnetic member affixed thereto may then be used to retrieve a circular marker formed of translucent material and having ferromagnetic properties after the marker has been utilized as an indicator in a game.

8 Claims, 4 Drawing Figures

MAGNETIC PICK-UP DEVICE AND MARKER

BACKGROUND OF THE INVENTION

Numerous board games utilize a plurality of markers to indicate a particular thing unique to that game. In particular, such games as bingo and lotto require a player to cover a series of numbers on a flat board as numbers are randomly picked.

In games where numerous markers are used, such as bingo, it becomes difficult to remove all of the markers between games. This is particularly evident when a single player is using several cards. In the past, the player either had to individually remove the chips or pick each card up and spill the markers or chips into a particular area for use during the next game.

Although previous bingo pick-up devices have been patented, such as that disclosed in U.S. Pat. No. 3,684,288, such devices have suffered from having insufficient surface area for pick-up of markers from numerous cards. In particular, the device disclosed in U.S. Pat. No. 3,684,288, while serving adequately for a limited number of markers, suffers in that there is insufficient contact area about the magnet for numerous markers or chips to be gathered thereabout. Particularly, the board game apparatus is extremely limited in that the stem portion which contains the magnet is limited to less than the size of the handle portion. Thus the magnet contained in the board game apparatus is similarly limited.

A cylindrical magnet, such as is used in the aforedescribed apparatus, has limited surface area. Furthermore, the curvilinear shape of the exterior surface of the stem in the aforedescribed patent provides only a tangential point of contact to which the flat marker or chips are attracted. Thus, the overall cylindrical shape provides only a limited capability to retrieve the markers or chips.

In most board games, it may be advantageous to provide the player with the capability of seeing the underlying number which the marker or chip covers. In order to provide a marker or chip with ferromagnetic properties, which is attracted to a magnetic pick-up device, it is necessary to either make the marker in an annular shape or embed a plurality of metal particles in the marker or chip. If a washer shape (annular ring) is utilized and the chip or marker is made of ferromagnetic material, the weight of the plurality of markers or chips becomes a factor. Therefore, utilizing a plastic material is appropriate. In order to obtain the ferromagnetic properties, it is necessary to embed a metallic material having ferromagnetic properties in the plastic. In earlier game apparatus, the markers or chips were described as having metal particles embedded in the plastic. This has proved relatively unsatisfactory in the manufacturing process in that the metallic chips tend to damage the machine cutting the circular marker shape. This coupled with the cylindrical shape of the earlier game apparatus prompted the improved game apparatus disclosed herein.

SUMMARY OF THE INVENTION

It is an object of this invention to provide an improved game marker pick-up device.

It is another object of this invention to provide a circular marker for use in board games and the like which has superior ferromagnetic property.

Broadly stated, the invention is a magnetic pick-up device and a marker for use in board games comprising an elongated handle. A ferromagnetic member having a rectangular cross section and a length substantially greater than the width, is disposed in a rectangular socket. The rectangular socket is affixed to the handle. A circular marker formed of translucent material has ferromagnetic properties, the marker is thereby attracted toward the ferromagnetic member when the ferromagnetic member is passed over the board game.

DETAILED DESCRIPTION OF THE PREFERRED EMBODIMENT

Figure 1:
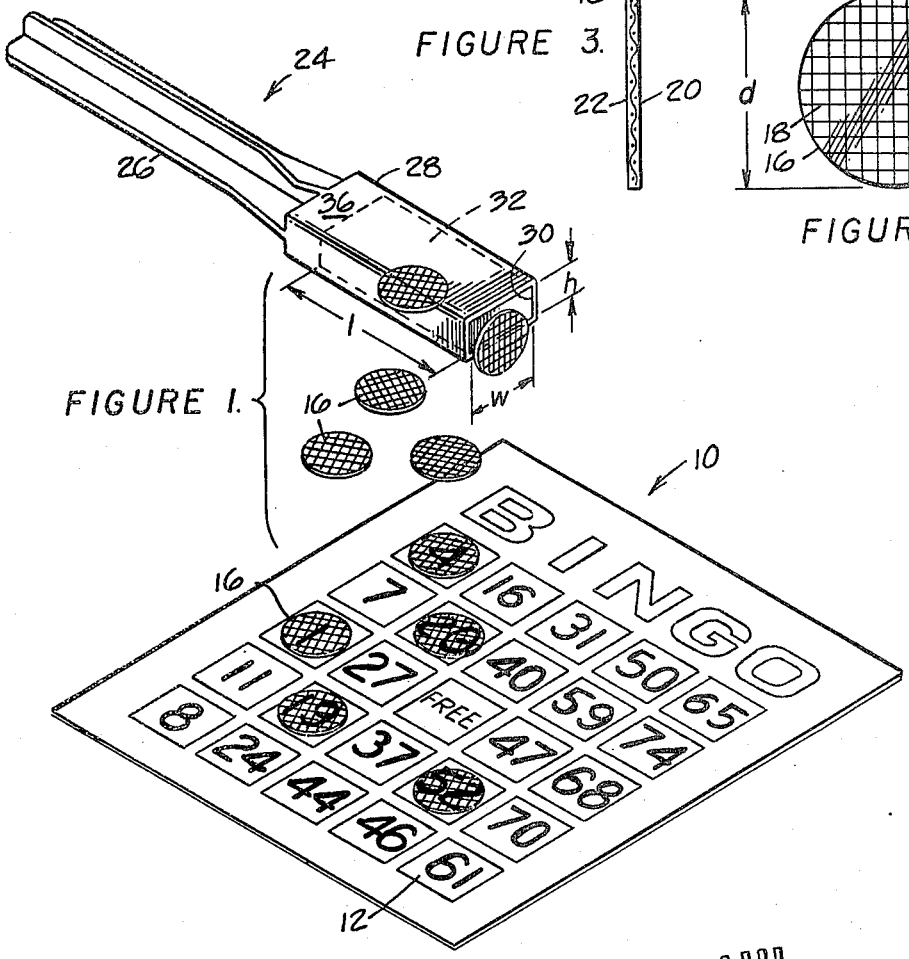
FIG. 1 is a perspective illustration of the magnetic pick-up device in use passing over a board game having disposed thereupon a plurality of markers.

Referring to FIG. 1, a board game is illustrated. In this particular instance, the game of "bingo" is utilized as an illustration. Hereafter the board game will be referred to as board game 10 and should be used in the generic sense wherein any board game utilizing at least one marker may be considered. In such board games, generally a plurality of spaces 12 may be identifiable by a matrix arrangement. In the particular board game 10, the columns are identifiable by letters, while the individual squares are identifiable by numerals. Other identification means may be appropriate such as a row, column coordinate system.

The usual object in such a game is to randomly identify particular squares on each game card. Since each game card may be made unique in each particular game, a particular pattern of markers, such as five markers in a row in the illustrated game may establish a winner.

Figure 3:
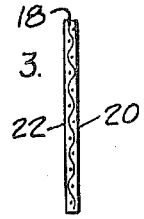
FIG. 3 is an elevational view of the marker shown in FIG. 2.
Figure 2:
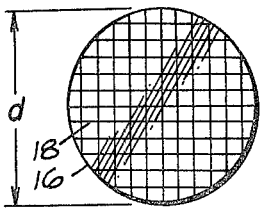
FIG. 2 is a plan view of a marker in accord with this invention.

The player is provided with a card and a plurality of markers 16. Each marker 16 as seen in FIGS. 2 and 3 is made of a translucent plastic material and has embedded therein a mesh material 18 which has ferromagnetic properties. It has been found appropriate to utilize a galvanized mesh to avoid unnecessary corrosion problems between the plastic material and the mesh 18 during the forming of the marker 16. It is readily seen that the marker 16 may be made in a large thin rectangular sheet and appropriate punches may be utilized to provide a large number of markers 16. The markers 16 each have first and second substantially parallel major surfaces 20 and 22 respectively. The mesh 18 is embedded between the first and second parallel surfaces 20 and 22 as indicated in FIG. 3 so that the metallic material does not ordinarily pierce either surface 22 or 20.

As previously noted the player utilizes a plurality of markers 16 as indicated in FIG. 1 to cover randomly selected numbers 12. When a winner is determined, the player will utilize a magnetic pick-up device 24 formed with an elongated handle 26 which may be cruciform in shape as indicated in FIG. 1. A rectangular socket 28 is affixed to handle 26 and is formed with a rectangular opening 30 adapted to receive a rectangular ferromagnetic member 32 and having cross sectional dimensions substantially equal to the cross sectional dimensions of ferromagnetic member 32 and a depth greater than the length of ferromagnetic member 32. The rectangular ferromagnetic member 32 as shown in FIG. 1 has a length 1, a width w, and a height h. The length 1 is purposely substantially greater than the width w, while the width w is preferably relatively larger than the diameter d of the marker 16.

The ferromagnetic member 32 may be fixedly retained within rectangular opening 30 by any appropriate bonding means such as glue or the like. Any appropriate ferromagnetic material having the properties of a permanent magnet may be used for ferromagnetic member 32, however, the stronger the permanent magnetic field the more appropriate the particular magnet will be to this invention.

The rectangular socket 28 having formed therein the rectangular opening 30 for receiving the ferromagnetic member has a relatively thin wall as indicated in FIG. 1 to provide the least degradation of magnetic force of ferromagnetic member 32.

Figure 4:
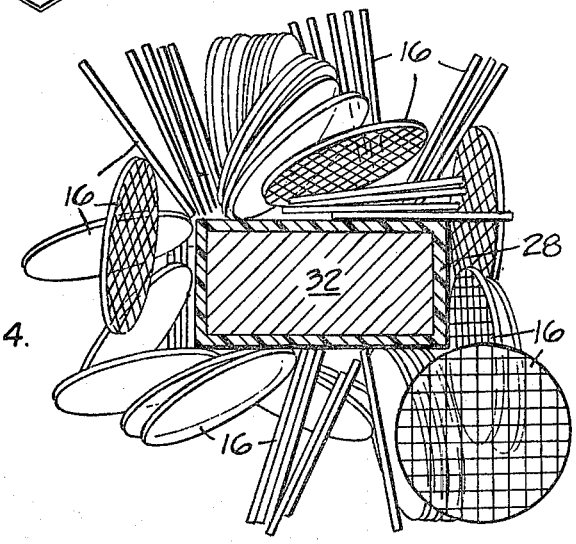
FIG. 4 is a cross sectional view of the magnetic pick-up device shown in FIG. 1 with a plurality of markers attracted thereto.

Referring to FIG. 4, it can be seen that the plurality of markers 16 are attracted to the ferromagnetic member in what would appear to be a rather random pattern. In fact, the mesh 18 permits the electromagnetic lines of force to develop secondary magnetic fields, thus attracting additional markers.

In use, the markers 16 are placed by the player on the game card 10 as illustrated in FIG. 1. When a winner is determined, the individual players pass the magnetic pick-up device 24 over game card 10 in the manner indicated in FIG. 1, thus attracting the plurality of markers in a cluster about the ferromagnetic member contained in socket 28. The plurality of members, as indicated in FIG. 4, may be readily removed by a player by merely placing one's fingers about the socket 28 at the handle end 36 as indicated in FIG. 1, and then pulling the entire magnetic pick-up device through the player's fingers, thus causing the plurality of markers 16 to fall into a dish or other device for holding the markers between games.

Although this particular magnetic pick-up device has been described in relation to a game card 10, it should be understood that there are other uses in the gaming environment wherein a plurality of markers may be appropriate. In other cases a single marker may be appropriate. Therefore, it is emphasized that this application should not be considered limited to the particular game card application described, but rather should be limited only so far as the appended claims.

What is claimed is:

1. A magnetic pick-up device and a marker comprising:

an elongated handle;

a ferromagnetic member having a rectangular cross section and a length substantially greater than its width;

a rectangular socket affixed to said handle for fixedly receiving internally said ferromagnetic member;

circular marker means for use with a game; said circular marker means comprising a translucent disc and a metallic screen, said screen having ferromagnetic properties, said translucent disc defining first and second substantially parallel surfaces, said screen embedded in said translucent disc between said first and second substantially parallel surfaces; whereby said marker means is attracted towards said ferromagnetic member when said ferromagnetic member is passed in the vicinity of said marker means.

2. The magnetic pick-up device of claim 1 wherein the metallic screen is circular.

3. The magnetic pick-up device of claim 2 wherein said socket is integrally formed with said handle.

4. The magnetic pick-up device of claim 3 wherein the socket defines an internal rectangular opening having cross sectional dimensions substantially equal to the cross sectional dimensions of the ferromagnetic member and a length greater than the length of said ferromagnetic member.

5. The magnetic pick-up device of claim 4 wherein said translucent disc has a diameter less than the width of said socket.

6. The magnetic pick-up device of claim 3 wherein the ferromagnetic member is bonded in said socket.

7. The magnetic pick-up device of claim 1 wherein the handle has a cruciform cross section.

8. A marker for use in playing a game, said marker comprising a translucent disc and a metallic screen, said screen having ferromagnetic properties, said translucent disc defining first and second substantially parallel surfaces, said screen embedded in said translucent disc between said first and second substantially parallel surfaces.

* * * * *